US006716053B2

(12) United States Patent
Ooishi

(10) Patent No.: US 6,716,053 B2
(45) Date of Patent: Apr. 6, 2004

(54) CONNECTOR

(75) Inventor: Akio Ooishi, Kanagawa (JP)

(73) Assignee: Tyco Electronics AMP, K.K., Kanagawa (JP)

( * ) Notice: Subject to any disclaimer, the term of this patent is extended or adjusted under 35 U.S.C. 154(b) by 0 days.

(21) Appl. No.: 10/404,633

(22) Filed: Apr. 1, 2003

(65) Prior Publication Data

US 2003/0186575 A1 Oct. 2, 2003

(30) Foreign Application Priority Data

Apr. 1, 2002 (JP) ..... 2002-99178

(51) Int. Cl.[7] ..... H01R 13/627
(52) U.S. Cl. ..... 439/354
(58) Field of Search ..... 439/296, 299, 439/310, 346, 352, 353, 354, 357, 358

(56) References Cited

U.S. PATENT DOCUMENTS 6,179,643 B1 1/2001 Fukuda ..... 439/358

FOREIGN PATENT DOCUMENTS

JP 1979-95630 7/1979
JP 1991-14425 3/1991

OTHER PUBLICATIONS

European Patent Office Search Report; app. No. EP 03 25 1856; dated Jul. 23, 2003.

*Primary Examiner*—Javaid H. Nasri
(74) *Attorney, Agent, or Firm*—Barley Snyder

(57) ABSTRACT

A plurality of inertial locking connectors wherein each inertial locking connector has a first housing having a locking part and a second housing having a locking arm with a locking projection. The locking projection has a contact surface formed on a front end of the locking projection with respect to a direction of mating and at an inclination with respect to the direction of mating. The contact surface engages the locking part when the first housing and the second housing are mated. Electrical contacts having a number of poles are accommodated in the first housing and the second housing. An angle of inclination is formed by a direction perpendicular to the mating direction and the contact surface. The angle of inclination decreases as the number of poles of the electrical contacts increases in each of the connectors.

19 Claims, 7 Drawing Sheets

(A)
Prior Art (B)
Prior Art

CONNECTOR

BACKGROUND OF THE INVENTION

The invention relates to an inertial locking connector. More specifically, the invention relates to an inertial locking connector wherein an angle of inclination of mating corresponds to the number of poles in the connector to prevent incomplete mating.

DESCRIPTION OF THE PRIOR ART

An example of a conventional inertial locking connector is shown in FIG. 6 and disclosed in Japanese Utility Model Application Kokoku No. S58-41745. The connector shown in FIG. 6 has a male housing 100 and a female housing 200 that face each other and are formed to be mated with each other. The male housing 100 and the female housing 200 accommodate electrical contacts (not shown).

The male housing 100 has locking arms 102 that extend rearward from a base part 101. The base part 101 has an inclined surface at a front end (the right end in FIG. 6) of an upper surface of the male housing 100 (with respect to a direction of mating). Operating parts 103 project from upper surfaces of the locking arms 102 proximate rear end portions (with respect to the direction of mating) corresponding to free end portions of the locking arms 102. Locking projections 104 project from substantially central portions (with respect to the direction of mating) of the upper surfaces of the locking arms 102. The locking projections 104 have inclined surfaces 104*a* that have a steep gradient on a front surface (with respect to the direction of mating) and inclined surfaces 104*b* that have a shallow gradient on a rear surface (with respect to the direction of mating). The inclined surfaces 104*a*, 104*b* converge to form a point 104*c*.

A male housing accommodating recess 203 is formed on a front part (the left end in FIG. 6) of the female housing 200 (with respect to the direction of mating). Locking parts 202 are formed on the front part (with respect to the direction of mating) of an upper wall 201 of the male housing accommodating recess 203. The locking parts 202 are formed to face an inside of the male housing accommodating recess 203. Inclined guiding surfaces 202*a* are formed on the front parts (with respect to the direction of mating) of the locking parts 202 for guiding the locking projections 104. Abutting step parts, which have a steeper inclination than the inclined guiding surfaces 202*a*, are formed on rear end portions of the locking parts 202 below the inclined guiding surfaces 202*a*. When the male housing 100 and female housing 200 are mated, the locking projections 104 bend the locking arms 102 downward while riding over the locking parts 202 and engage with the locking parts 202.

Another example of a conventional inertial locking connector is shown in FIG. 7 and disclosed in Japanese Japanese Utility Model Registration No. 2522319. The connector shown in FIG. 7 has a male housing 301 and a female housing (only a mating hood 401 of the female housing is shown) that face each other and are formed to be mated with each other. The male housing 301 and the female housing accommodate electrical contacts (not shown).

Locking arms 302 are arranged on an upper surface of the male housing 301 so that the locking arms 302 extend rearward from a front end (left end in FIG. 7(A)) with respect to a direction of mating. Operating parts 303 project from rear end portions (with respect to the direction of mating) of upper surfaces of the locking arms 302 corresponding to free end portions of the locking arms 302.

Locking projections 304 project from substantially central portions (with respect to the direction of mating) of the upper surfaces of the locking arms 302.

Locking parts 402 project downward and are arranged on a front end (right end in FIG. 7(A)) of the mating hood 401 of the female housing with respect to the direction of mating. When the male housing 301 and the female housing are mated, the locking projections 304 bend the locking arms 302 downward while riding over the locking parts 402. The upper surfaces of the locking projections 304 are constructed as overriding sliding contact surfaces 304*b*. The overriding sliding contact surfaces 304*b* are inclined with respect to the direction of mating in a free state of the locking arms 302. The angle of inclination of the overriding sliding contact surfaces 304*b* substantially coincides with the maximum flexing angle of the locking arms 302. Contact surfaces 304*a* are formed on the front ends of the overriding sliding contact surfaces 304*b* with respect to the direction of mating. The contact surfaces 304*a* are inclined with respect to the direction of mating in the free state of the locking arms 302. The angle of inclination of the sliding contact surfaces 304*a* is greater than the angle of inclination of the overriding sliding contact surfaces 304*b*.

When the male housing 301 and the female housing are mated, the contact surfaces 304*a* first contact the lower end edges of the front surfaces of the locking parts 402. As the male housing 301 advances in the direction of mating, the front end edges of the overriding sliding contact surfaces 304*b* ride over the lower end edges of the front surfaces of the locking parts 402, as shown in FIG. 7(A), so that the locking arms 302 reach a maximum flexing angle. In this state, the overriding sliding contact surfaces 304*b* are in a substantially horizontal position along the direction of mating. As the male housing 301 is inserted further into the female housing, the overriding sliding contact surfaces 304*b* slide along the bottom surfaces of the locking parts 402. The maximum flexing angle of the locking arms 302 is maintained until the rear end edges of the overriding sliding contact surfaces 304*b* reach the lower end edges of the rear surfaces of the locking parts 402. As the male housing 301 is inserted still further, the rear end edges of the overriding sliding contact surfaces 304*b* advance beyond the locking parts 402 and the locking arms 302 return to their original state to lock the locking projections 304 on the locking parts 402.

The relationship between the insertion stroke and the housing insertion force in the above-described series of mating operations is shown in FIG. 7(B). Specifically, the housing insertion force reaches its peak value (a) when the front end edges of the overriding sliding contact surfaces 304*b* ride over the lower end edges of the front surfaces of the locking parts 402 so that the locking arms 302 reach the maximum flexing angle shown in FIG. 7(A). The peak value (a) is determined by the angle of inclination of the contact surfaces 304*a*. The angle of inclination is the angle formed by a direction perpendicular to the direction of mating and the contact surfaces 304*a*. In instances where the angle of inclination is small, the peak value (a) of the housing insertion force is large. In cases where the angle of inclination is large, the peak value (a) of the housing insertion force is small.

When the overriding sliding contact surfaces 304*b* begin to slide along the bottom surfaces of the locking parts 402, the housing insertion force drops as indicated at (b) in FIG. 7(B). This housing insertion force is maintained until the rear end edges of the overriding sliding contact surfaces 304*b* reach the lower end edges of the rear surfaces of the locking parts 402. When the rear end edges of the overriding sliding contact surfaces 304*b* leave the locking parts 402, the housing insertion force becomes zero in a single stroke as indicated at (c) in FIG. 7(B), and the locking projections 304 are instantly locked on the locking parts 402.

Since the housing insertion force has an initial maximum peak value (a) that then decreases until the locked state (c) is reached, this type of connector is called an inertial locking type connector. Specifically, during mating of the connectors, an worker must initially apply some degree of housing insertion force. The insertion force, however, subsequently rapidly decreases so that the connector is inertially pushed into a locked state in a single stroke. As a result, a state of incomplete mating can be prevented.

In the inertial locking type connector, the peak value (a) of the housing insertion must be slightly greater than the overall load arising from mating the plurality of electrical contacts that contact each other in order to prevent incomplete mating. If the peak value (a) is not slightly greater than the overall load, the worker can not inertially mate the connector. Because the worker generally looks at the size or number of poles of the connector and roughly estimates the force required for mating, if the angle of inclination is uniformly set at a small value regardless of the number of poles, the peak value of the housing insertion force will exceed the overall load when the number of poles is small. Thus, a housing insertion force exceeding the estimate made by the worker is required to inertially mate the connectors and as such unfavourable mating of the connectors occurs.

It is therefore desirable to develop an inertial locking connector wherein the angle of inclination of the contact surfaces of the locking projections can be varied in accordance with the number of poles so that a state of incomplete mating can be prevented and the characteristics of the mating operation of connectors with a small number of poles can be improved.

SUMMARY OF THE INVENTION

The invention relates to an inertial locking connector. The inertial locking connector has a male housing having a locking arm with a locking projection. The locking projection has a contact surface formed on a front end of the locking projection with respect to a direction of mating and at an inclination with respect to the direction of mating. The contact surface engages a locking part on a female housing when the male housing and the female housing are mated. The male housing has an angle of inclination formed by a direction perpendicular to the mating direction and the contact surface. The angle of inclination decreases as the number of poles of electrical contacts increases in the female housing.

BRIEF DESCRIPTION OF THE DRAWINGS

FIG. 2(A) is a front plan view; FIG. 2(B) is a sectional view along line 2B—2B of FIG. 2(A); FIG. 2(C) is a top plan view;

FIG. 3(A) is a plan front view; FIG. 3(B) is a sectional view along line 3B—3B of FIG. 3(A); and FIG. 3(C) is a top plan view;

FIG. 4(A) is a front plan view; FIG. 4(B) is a sectional view along line 4B—4B of FIG. 4(A); and FIG. 4(C) is a top plan view;

FIG. 5(A) is a front plan view; FIG. 5(B) is a sectional view along line 5B—5B of FIG. 5(A); and FIG. 5(C) is a top plan view;

FIG. 7(A) is a schematic explanatory diagram of the main parts; and FIG. 7(B) is a graph that illustrates the relationship between insertion stroke and housing insertion force.

DETAILED DESCRIPTION OF THE PREFERRED EMBODIMENT

Figure 1:
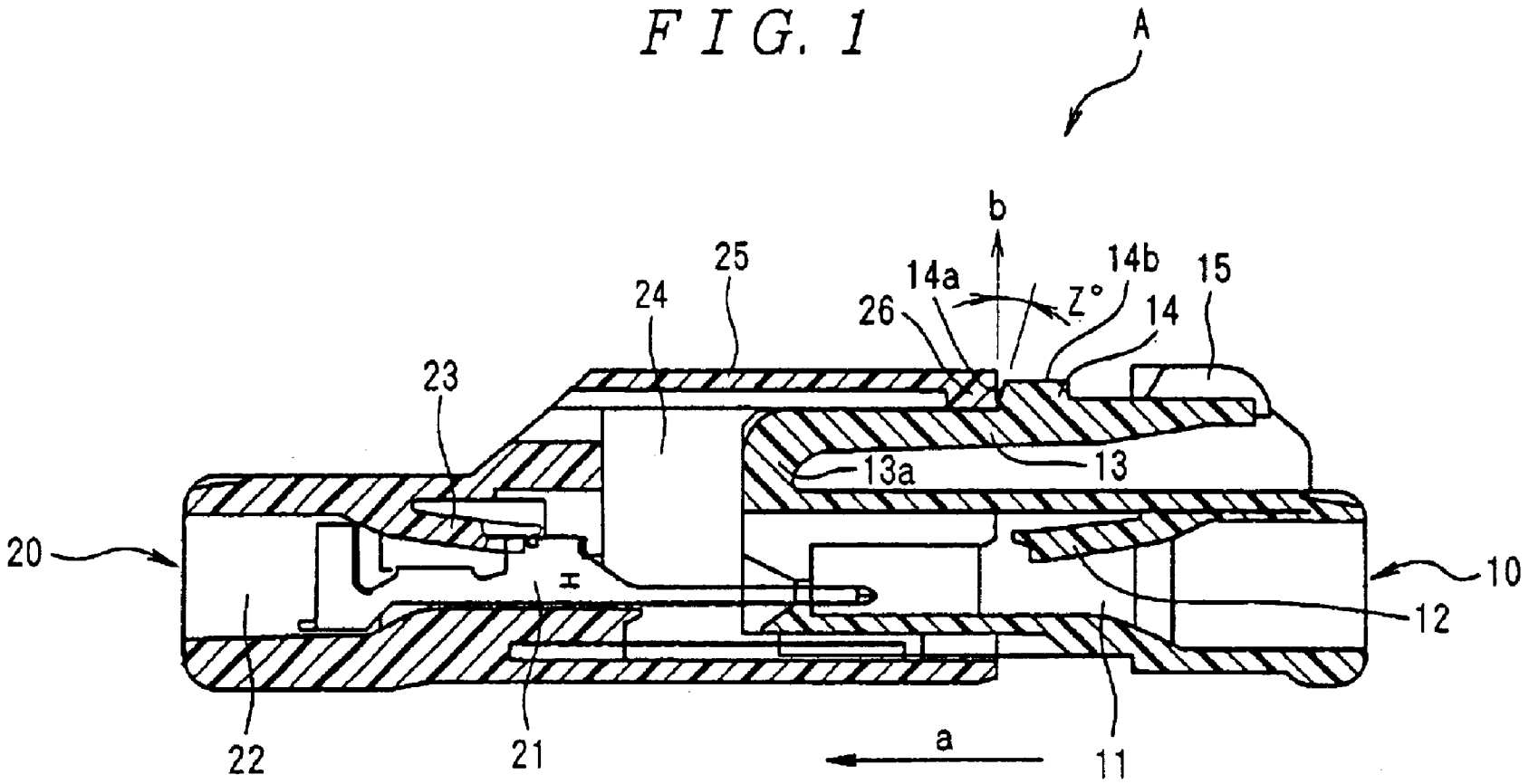
FIG. 1 is a sectional view of an inertial locking connector.

As shown in FIG. 1, inertial locking connector A has a male housing 10 and a female housing 20. The male housing 10 accommodates female electrical contacts (not shown). The female housing 20 faces the male housing 10 and accommodates male electrical contacts 21. The connector A is arranged so that the male housing 10 is mated with the female housing 20 in a direction of mating indicated by arrow a. When the male housing 10 and the female housing 20 are mated, the electrical contacts (not shown) of the male housing 10 and the electrical contacts 21 of the female housing 20 contact each other and are electrically connected.

The female housing 20 has contact accommodating passages 22. Elastic lances 23 are formed in the contact accommodating passages 22 to anchor the electrical contacts 21. A male housing accommodating recess 24 is formed in the front part (right part in FIG. 1) of the female housing 20. A locking part 26 is formed on a front end of an upper wall 25 of the male housing accommodating recess 24 and projects toward an interior of the male housing accommodating recess 24.

The male housing 10 has contact accommodating passages 11. Elastic lances 12 used to anchor the electrical contacts (not shown) are disposed in the contact accommodating passages 11. Locking arms 13 are disposed on an upper surface of the male housing 10 and extend rearward from a base part 13*a*. The base part 13*a* extends from a front end of the male housing 10 with respect to the direction of mating a (i.e., the left end in FIG. 1). An operating part 15 projects from an upper surface of a rear end portion of the locking arms 13 (with respect to the direction of mating a), which corresponds to free end portions of the locking arms 13. Locking projections 14 project from substantially a central portion of upper surfaces of the locking arms 13 with respect to the direction of mating a. When the male housing 10 and female housing 20 are mated, the locking projections 14 bend the locking arms 13 downward while riding over the locking part 26 and engage with the locking part 26. Upper surfaces of the locking projections 14 are constructed as overriding sliding contact surfaces 14*b*. Contact surfaces 14*a* that are inclined with respect to the direction of mating a are formed on the front ends of the overriding sliding contact surfaces 14*b* with respect to the direction of mating a. The contact surfaces 14*b* contact the locking part 26 in an initial stage of mating of the male housing 10 and the female housing 20, The contact surfaces 14*a* are formed so that an angle of inclination angle Z° decreases as the number of poles of the electrical contacts increases in a plurality of connectors A. The angle of inclination Z° is the angle formed by a direction perpendicular to the direction of mating indicated by the arrow b and the contact surfaces 14*a*. Table 1 shows an example of an arrangement in which the angle of inclination Z° of the contact surfaces 14*a* decreases as the number of poles of the electrical contacts increases.

TABLE 1

| Number of Poles (P) | Angle of Inclination Z of Initial Contact Sliding Surfaces (°) | Overall Load from Contact of Contacts (N) | Peak Value of Housing Insertion Force (N) |
|---|---|---|---|
| 2 | 21 | 8.8 | 9.8 |
| 3 | 14 | 13.2 | 14.7 |
| 4 | 9 | 17.6 | 19.6 |
| 6 | 6 | 26.4 | 28.4 |

As shown in Table 1, as the number of poles of the electrical contacts is increased from 2 pole (P) to 3P, 4P and 6P, the angle of inclination Z° of the contact surfaces 14*a* is gradually reduced from 21° to 14°, 9° and 6°, respectively. In instances where the number of poles of the electrical contacts is increased from 2P to 3P, 4P and 6P, the overall load arising from the contact of the electrical contacts gradually increases from 8.8 N to 13.2 N, 17.6 N and 26.4 N, respectively. If the angle of inclination Z° of the contract surfaces 14*a* is 21°, 14°, 9° and 6° in instances where the number of poles of the electrical contacts is 2P, 3P, 4P and 6P, respectively, the peak value of the housing insertion force will increase with an increase in the number of poles, i.e., 9.8 N, 14.7 N, 19.6 N and 28.4 N, respectively, so that the peak value is slightly greater than the overall load arising from the contact of the electrical contacts at the respective number of poles.

In the illustrated embodiment, the connector A is constructed so that the angle of inclination Z° decreases as the number of poles of the electrical contacts increases. Accordingly, the peak value of the housing insertion force is large in connectors that have a large number of poles, and the peak value of the housing insertion force is small in connectors that have a small number of poles. Thus, the peak value of the housing insertion force is slightly larger than the overall load arising from the contact of the electrical contacts regardless of the number of poles in the connector so that incomplete mating can be prevented. Further, in connectors with a small number of poles, the characteristics of the mating operation are optimal since the peak value of the housing insertion force is small.

The mating of the male housing 10 and female housing 20 of the connector will now be described in greater detail. When the male housing 10 and female housing 20 are mated, the contact surfaces 14*a* of the locking projections 14 first contact the lower end edge of the front surface of the locking part 26. As the male housing 10 is further inserted into the female housing 20, the front end edges of the overriding sliding contact surfaces 14*b* slide over the lower end edge of the front surface of the locking part 26 to cause the locking arms 13 to reach the maximum flexing angle. When the locking arms 13 reach the maximum flexing angle, the housing insertion force is at the peak value. As the male housing 10 is further inserted into the female housing 20, the overriding sliding contact surfaces 14*b* slide along the bottom surface of the locking part 26. When the overriding sliding contact surfaces 14*b* begin to slide along the bottom surface of the locking part 26, the housing insertion force drops. As the male housing 10 is inserted even further into the female housing 20, the rear end edges of the overriding sliding contact surfaces 14*b* leave the locking part 26 toward the locking side, and the locking arms 13 return to their original state so that the housing insertion force goes to zero in a single stroke. The locking projections 14 are inertially locked on the locking part 26.

An example of an inertial locking connector having 2P will now be described in greater detail with reference to FIGS. 2 and 3. The 2P connector has a male housing 10, shown in FIG. 2, and a female housing 20, shown in FIG. 3, that faces the male housing 10 so that the male housing 10 can be mated with the female housing 20. The male housing 10 and the female housing 20 each accommodate two electrical contacts (not shown). When the male housing 10 and the female housing 20 are mated, the electrical contacts (not shown) of the male housing 10 and the electrical contacts (not shown) of the female housing 20 contact each other and are electrically connected.

Figure 3:
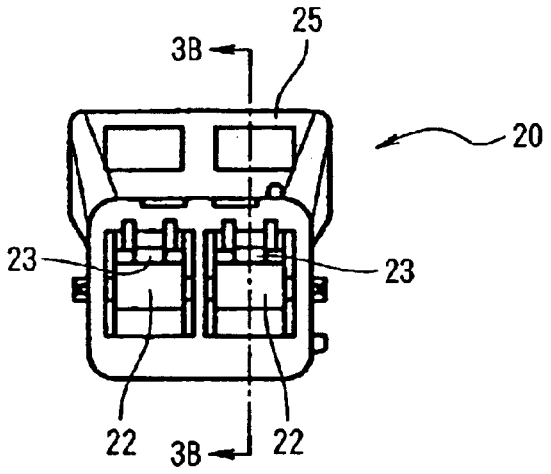
FIG. 3 shows a female housing of a 2 pole connector.
Figure 3:
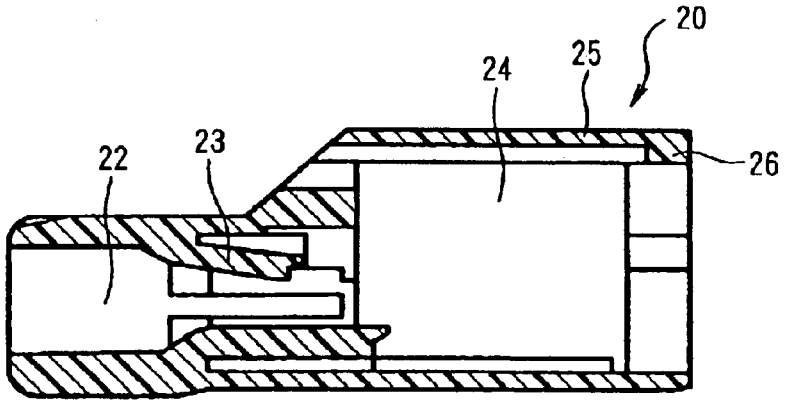
Figure 3:
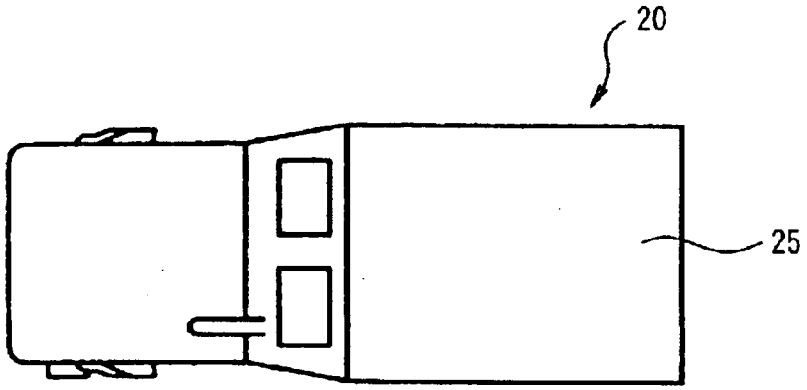

As shown in FIG. 3, the female housing 20 has two contact accommodating passages 22. Elastic lances 23 are formed in the respective contact accommodating passages 22 and are used to anchor the electrical contacts (not shown). A male housing accommodating recess 24 is formed in a front part (right part in FIG. 3(B)) of the female housing 20. A locking part 26 that projects toward an interior of the male housing accommodating recess 24 is formed on a front end of an upper wall 25 of the male housing accommodating recess 24.

Figure 2:
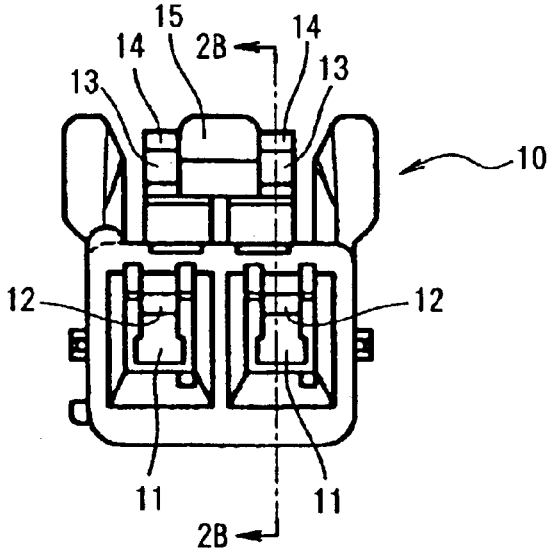
FIG. 2 shows a male housing of a 2 pole connector.
Figure 2:
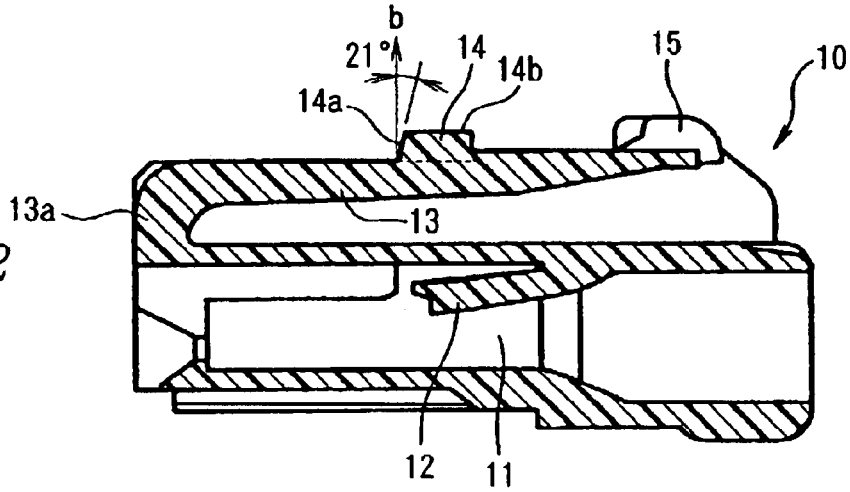
Figure 2:
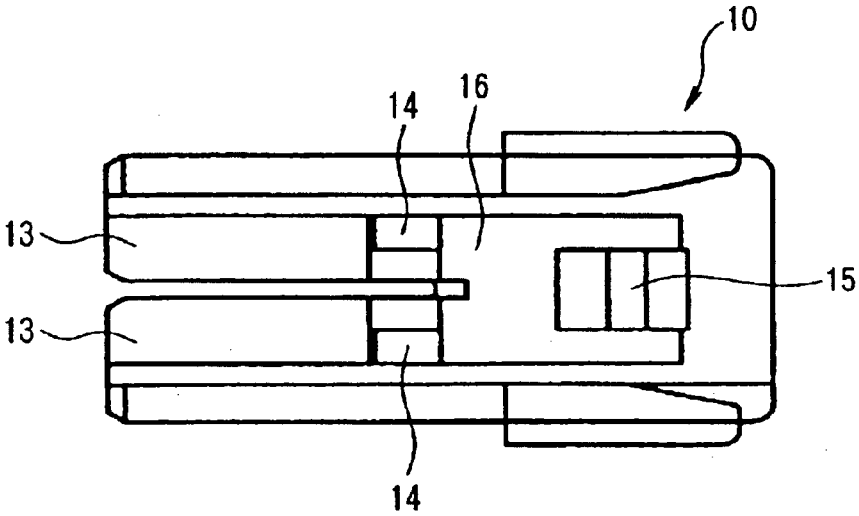

As shown in FIG. 2, the male housing 10 has two contact accommodating passages 11. Elastic lances 12 are formed in the respective contact accommodating passages 11 and are used to anchor the electrical contacts (not shown). Two locking arms 13 are disposed on an upper surface of the male housing 10 so that the locking arms 13 extend rearward from a base part 13*a* that rises from a front end of the male housing 10 with respect to a direction of mating (i.e., the left end in FIG. 2(B)). A connecting part 16 connects the locking arms 13 and is disposed on rear end portions of the locking arms 13, which correspond to the free end portions of the two locking arms 13. An operating part 15 projects from an upper surface of the connecting part 16. Locking projections 14 project from substantially central portions (with respect to the direction of mating) of upper surfaces of the respective locking arms 13. When the male housing 10 and the female housing 20 are mated, the locking projections 14 bend the locking arms 13 downward while sliding over the locking part 26 and engage with the locking part 26. The upper surfaces of the locking projections 14 are constructed as overriding sliding contact surfaces 14*b*. Contact surfaces 14*a*, which are inclined with respect to the direction of mating, contact the locking part 26 in an initial stage of mating of the male housing 10 and female housing 20 and are formed on front ends (with respect to the direction of mating) of the overriding sliding contact surfaces 14*b*.

When the contact surfaces 14*a* are formed, the angle of inclination formed by a direction that is perpendicular to the direction of mating b and the contact surfaces 14*a* is 21°, as shown in Table 1. If the angle of inclination of the contact surfaces 14*a* is set at 21° when the number of poles of the electrical contacts is 2P, the peak value of the housing insertion force will be 9.8 N, as shown in Table 1. Because the peak value is slightly larger than the overall load of 8.8 N arising from the contact of the electrical contacts, even in instances where the number of poles of the electrical contacts is 2P, incomplete mating can be prevented. Since the peak value of the housing insertion force is small, the characteristics of the mating operation are favourable.

An example of an inertial locking connector having 6P will now be described in greater detail with reference to FIGS. 4 and 5. The connector is constructed from a male housing 10, shown in FIG. 4, and a female housing 20, shown in FIG. 5, that faces the male housing 10. The connector is arranged so that the male housing 10 is mated with the female housing 20. The male housing 10 and the female housing 20 each accommodate six electrical contacts (not shown). When the male housing 10 and the female housing 20 are mated, the electrical contacts (not shown) of the male housing 10 and the electrical contacts (not shown) of the female housing 20 contact each other and are electrically connected.

Figure 5:
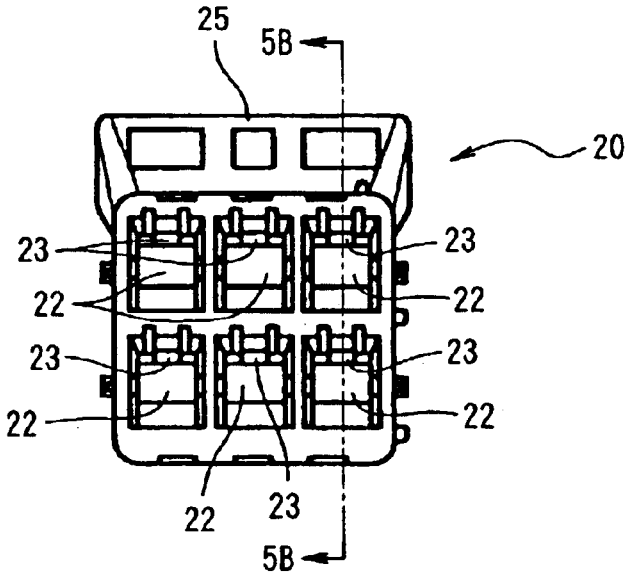
FIG. 5 shows a female housing of a 6 pole connector.
Figure 5:
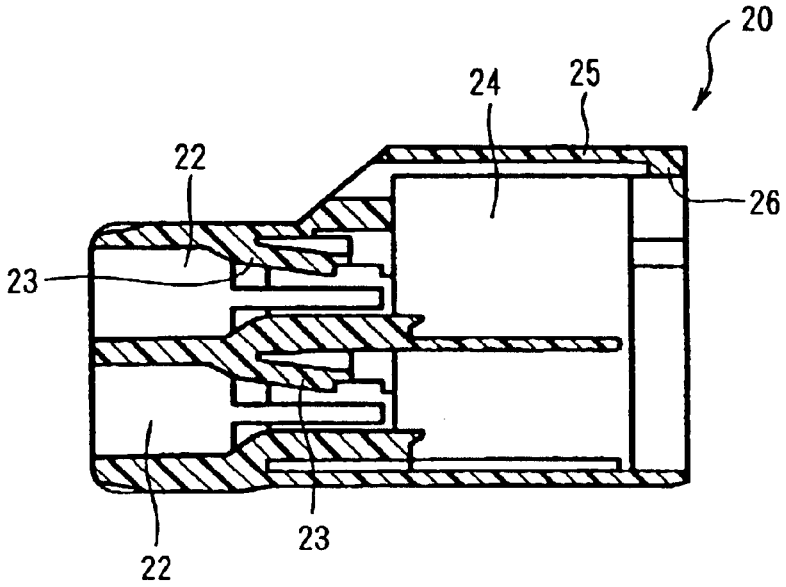
Figure 5:
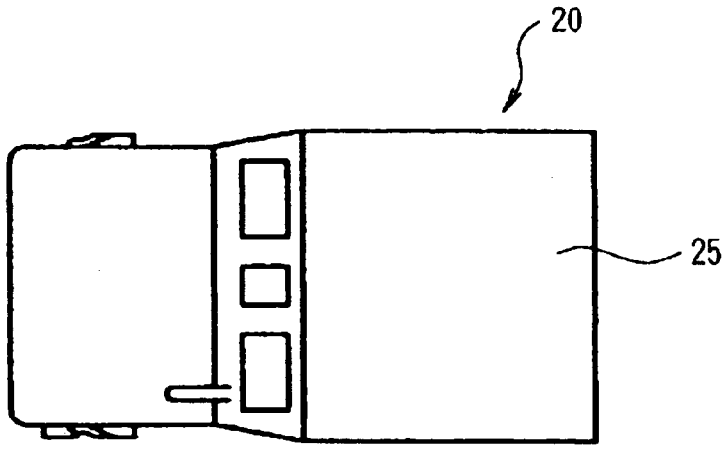
Figure 6:
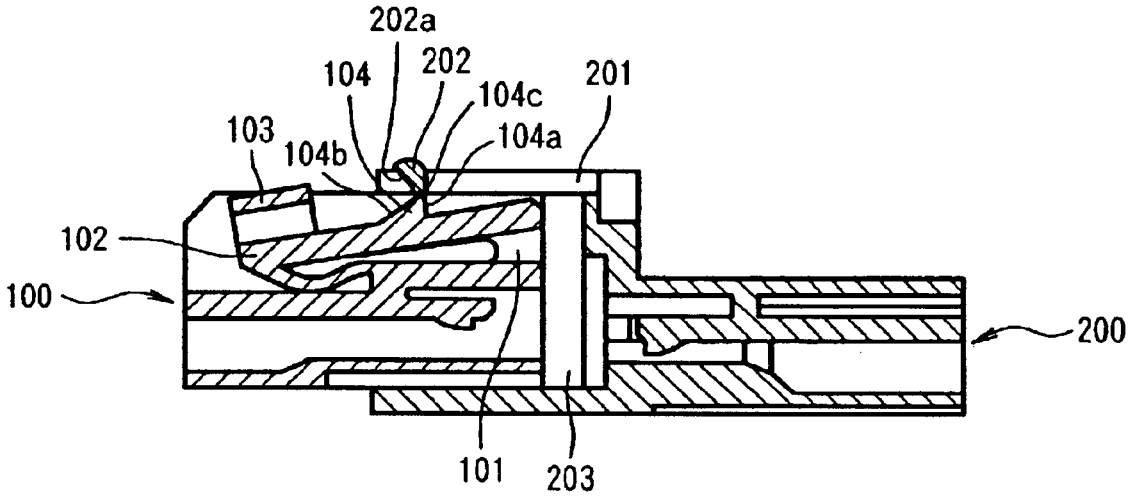
FIG. 6 Prior Art
FIG. 6 is a sectional view of a conventional inertial locking connector.
Figure 7:
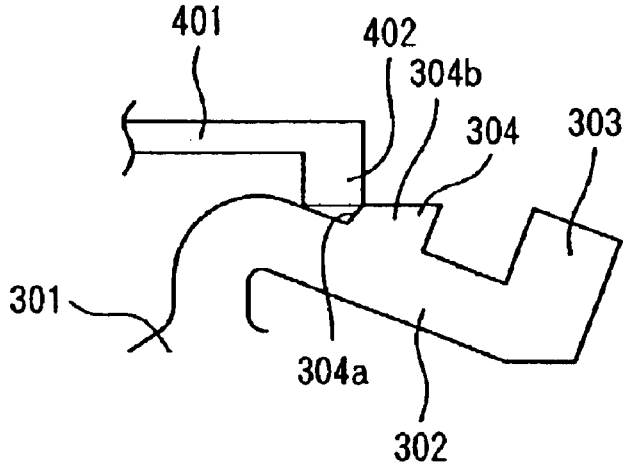
FIG. 7 shows another conventional inertial locking connector.
Figure 7:
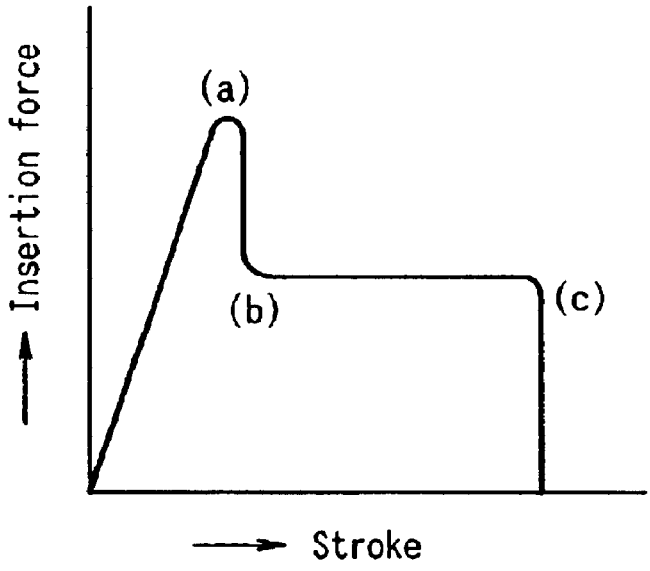

As shown in FIG. 5, the female housing 20 has six contact accommodating passages 22. The contact accommodating passages 22 are formed with three passages above and below each other. Elastic lances 23 are formed in the respective contact accommodating passages 22 and are used to anchor the electrical contacts (not shown). A male housing accommodating recess 24 that accommodates the male housing 10 is formed in a front part of the female housing 20. A locking part 26 projects toward an interior of the male housing accommodating recess 24 and is formed on a front end of an upper wall 25 of the male housing accommodating recess 24.

Figure 4:
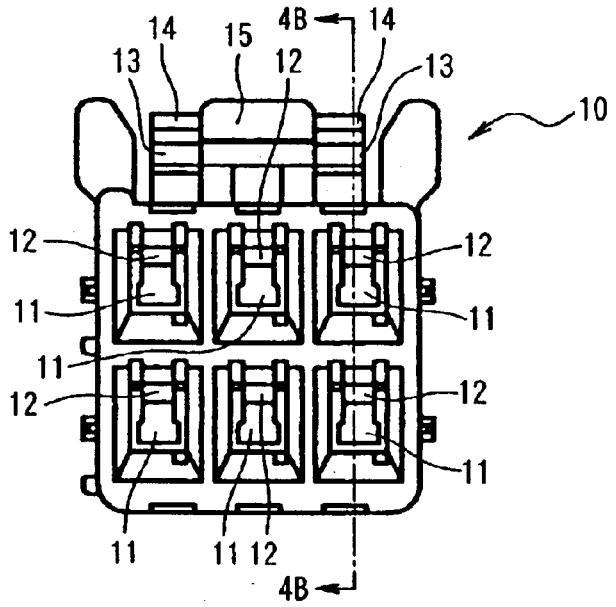
FIG. 4 shows a male housing of a 6 pole connector.
Figure 4:
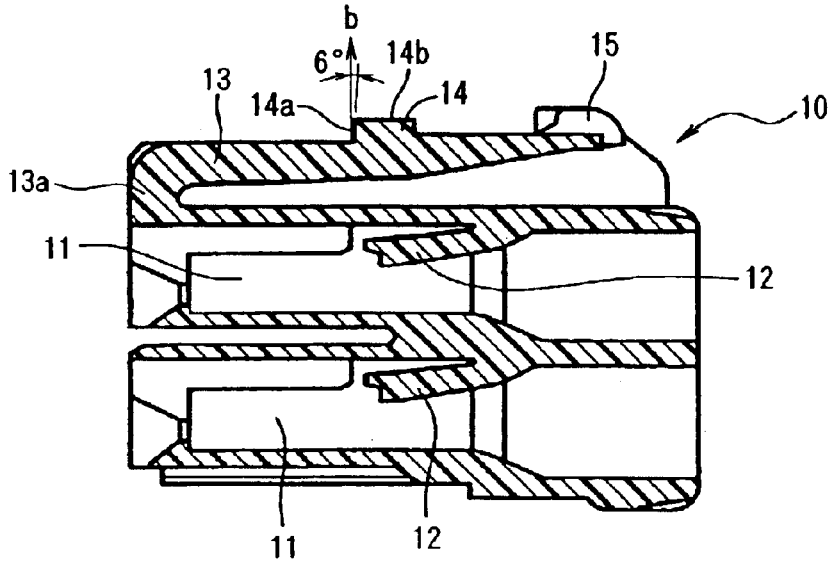
Figure 4:
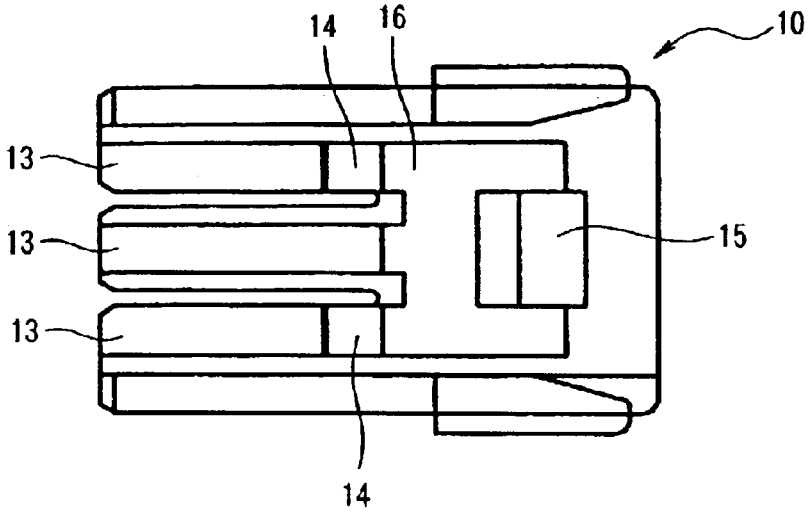

As shown in FIG. 4, the male housing 10 has six contact accommodating passages 11. The contact accommodating passages 11 are formed with three passages above and below each other. Elastic lances 12 are formed in the respective contact accommodating passages 11 and are used to anchor the electrical contacts (not shown). Three locking arms 13 are disposed on an upper surface of the male housing 10 so that the locking arms 13 extend rearward from a base part 13*a* that rises from a front end of the male housing 10 with respect to a direction of mating a. A connecting part 16, which connects the locking arms 13, is disposed on rear end portions (with respect to the direction of mating) of the three locking arms 13 and corresponds to the free end portions of the locking arms 13. An operating part 15 projects from an upper surface of the connecting part 16. Locking projections 14 project from substantially central portions (with respect to the direction of mating) of upper surfaces of the two locking arms 13 and are located on an outside of the locking arms 13 (among the three). When the male housing 10 and female housing 20 are mated, the locking projections 14 bend the locking arms 13 downward while riding over the locking part 26 and engage with the locking part 26. The upper surfaces of the locking projections 14 are constructed as overriding sliding contact surfaces 14*b*. Contact surfaces 14*a* that are inclined with respect to the direction of mating and contact the locking part 26 in the initial stage of mating of the male housing 10 and female housing 20, are formed on the front ends (with respect to the direction of mating) of the overriding sliding contact surfaces 14*b*.

When the contact surfaces 14*a* are formed, the angle of inclination formed by a direction that is perpendicular to the direction of mating b and the contact surfaces 14*a* is 6°, as shown in Table 1. If the angle of inclination of the contact surfaces 14*a* is 6° in a case where the number of poles of the electrical contacts is 6P, then the peak value of the housing insertion force will be 28.4 N, as shown in Table 1. The peak value is slightly greater than the overall load of 26.4 N arising from the contact of the electrical contacts (not shown). Accordingly, a state of incomplete mating can be prevented even in cases where the number of poles of the electrical contacts is 6P.

In the invention described herein, a plurality of connectors with different numbers of poles are constructed so that the angle of inclination formed by the direction perpendicular to the direction of mating and the contact surfaces of the locking projections decreases as the number of poles of the electrical contacts increases. Accordingly, the peak value of the housing insertion force is large in connectors with a large number of poles and small in connectors with a small number of poles. Consequently, the peak value of the housing insertion force can be made slightly larger than the overall load arising from the contact of the electrical contacts regardless of the number of poles in the connector. As a result, an inertial locking type connector can be obtained in which a state of incomplete mating can be prevented and the characteristics of the mating operation of a connector with a small number of poles of the electrical contacts are favourable.

Embodiments of the present invention have been described herein. However, many other embodiments are possible within the scope and spirit of the invention. For example, the connector may be applied not only to connectors in which the number of poles is 2P, 3P, 4P or 6P, as shown in Table 1, but also to any plurality of connectors in which the numbers of poles are different. It is, therefore, intended that the foregoing description be regarded as illustrative rather than limiting and that the scope of the invention is given by the appended claims together with their full range of equivalents.

I claim:

1. An inertial locking connector comprising:

a male housing having a locking arm with a locking projection, the locking projection having an inclined contact surface formed on a front end of the locking projection with respect to a direction of mating, the contact surface engages a locking part on a female housing when the male housing and the female housing are mated, and the male housing having an angle of inclination formed by a direction perpendicular to the mating direction and the contact surface, the angle of inclination decreases as the number of poles of electrical contacts increases in the female housing.

2. The inertial locking connector of claim 1, wherein when the number of poles is 2P, 3P, 4P and 6P, the angle of inclination is approximately 21 degrees, 14 degrees, 9 degrees, and 6 degrees, respectively.

3. The inertial locking connector of claim 1, wherein when the number of poles is 2P the angle of inclination is approximately 21 degrees and when the number of poles is 6P, the angle of inclination is approximately 6 degrees.

4. The inertial locking connector of claim 1, further comprising an elastic lance that extends into contact accommodating passageways to anchor the electrical contacts.

5. The inertial locking connector of claim 1, wherein the locking arm is disposed on an upper surface of the male housing.

6. The inertial locking connector of claim 1, wherein the locking arm extends rearward from a base part disposed at a front end of the male housing with respect to the direction of mating.

7. The inertial locking connector of claim 1, wherein the locking projection projects from a central portion of the locking arm.

8. The inertial locking connector of claim 1, wherein the male connector includes an operating part that projects from an upper surface of a free end of the locking arm.

9. A plurality of inertial locking connectors, each inertial locking connector comprising:

a first housing having a locking part;

a second housing having a locking arm with a locking projection, the locking projection having an inclined contact surface formed on a front end of the locking projection with respect to a direction of mating, the contact surface engages the locking part when the first housing and the second housing are mated;

electrical contacts having a number of poles are accommodated in the first housing and the second housing; and the second housing having an angle of inclination formed by a direction perpendicular to the mating direction and the contact surface, the angle of inclination decreases as the number of poles of the electrical contacts increases in each of the connectors.

10. The plurality of inertial locking connectors of claim 9, wherein when the number of poles is 2P, 3P, 4P and 6P, the angle of inclination is approximately 21 degrees, 14 degrees, 9 degrees, and 6 degrees, respectively.

11. The plurality of inertial locking connectors of claim 9, wherein when the number of poles is 2P the angle of inclination is approximately 21 degrees and when the number of poles is 6P, the angle of inclination is approximately 6 degrees.

12. The plurality of inertial locking connectors of claim 9, wherein the first housing has a second housing accommodating recess and a face of the locking part projects from a wall of the first housing toward an interior of the second housing accommodating recess.

13. The plurality of inertial locking connectors of claim 9, further comprising elastic lances that extend into contact accommodating passageways to anchor the electrical contacts.

14. The plurality of inertial locking connectors of claim 9, wherein the locking arm is disposed on an upper surface of the second housing.

15. The plurality of inertial locking connectors of claim 9, wherein the locking arm extends rearward from a base part disposed at a front end of the second housing with respect to the direction of mating.

16. The plurality of inertial locking connectors of claim 9, wherein the locking projection projects from a central portion of the locking arm.

17. The plurality of inertial locking connectors of claim 9, wherein the locking part abuts a rear surface of the locking projection when the first housing and the second housing are mated.

18. The plurality of inertial locking connectors of claim 9, wherein the second connector includes an operating part that projects from an upper surface of a free end of the locking arm.

19. A method of making an inertial locking connector comprising:

forming a housing to have a locking arm with a locking projection;

forming the locking projection to have an inclined contact surface on a front end with respect to a direction of mating with another housing;

positioning the contact surface to engage a locking part on the other housing when the housings are mated;

profiling the contact surface to have an angle of inclination formed by a direction perpendicular to the mating direction and the contact surface; and varying the angle of inclination such that the angle of inclination decreases as a number of poles of electrical contacts increases in the other housing.

* * * * *